US007493847B2

(12) United States Patent
Yajima et al.

(10) Patent No.: US 7,493,847 B2
(45) Date of Patent: Feb. 24, 2009

(54) FLUID PRESSURE CYLINDER WITH POSITION DETECTING DEVICE

(75) Inventors: Hisashi Yajima, Tsukubamirai (JP); Nobuhiro Fujiwara, Tsukubamirai (JP)

(73) Assignee: SMC Corporation, Tokyo (JP)

( * ) Notice: Subject to any disclaimer, the term of this patent is extended or adjusted under 35 U.S.C. 154(b) by 74 days.

(21) Appl. No.: 11/452,942

(22) Filed: Jun. 15, 2006

(65) Prior Publication Data

US 2006/0285978 A1 Dec. 21, 2006

(30) Foreign Application Priority Data

Jun. 20, 2005 (JP) ..... 2005-179428

(51) Int. Cl.
*F01B 31/12* (2006.01)

(52) U.S. Cl. ..... 92/5 R

(58) Field of Classification Search ..... 92/5 R
See application file for complete search history.

(56) References Cited

U.S. PATENT DOCUMENTS 3,898,555 A 8/1975 Tellerman
5,514,961 A * 5/1996 Stoll et al. ..... 324/207.13
2004/0196117 A1 10/2004 Kiessling et al.

FOREIGN PATENT DOCUMENTS

JP 9-329409 12/1997

* cited by examiner

*Primary Examiner*—F. Daniel Lopez
(74) *Attorney, Agent, or Firm*—Oblon, Spivak, McClelland, Maier & Neustadt, P.C.

(57) ABSTRACT

In a fluid pressure cylinder with a magnetostriction type position detecting device for detecting an operating position of a piston using the position detecting device, the fluid pressure cylinder is provided with a simple and rational design structure without providing it with a special conductive member as a current feedback conductor. In the fluid pressure cylinder with the magnetostriction type position detecting device having a permanent magnet attached to the piston and a magnetostrictive line accommodated in a hollow portion of a cylinder tube, the cylinder tube is formed of a non-magnetic conductive material, the magnetostrictive line composed of a ferromagnetic material is inserted into the hollow portion, and the extreme end of the magnetostrictive line is electrically connected to the cylinder tube through a support metal fitting, thereby the cylinder tube is also used as a current feedback conductor.

16 Claims, 2 Drawing Sheets

FLUID PRESSURE CYLINDER WITH POSITION DETECTING DEVICE

TECHNICAL FIELD

The present invention relates to a fluid pressure cylinder with a position detecting device for detecting an operating position of a piston by a magnetostriction type position detecting device.

BACKGROUND ART

A patent document 1 discloses a technology for detecting an operating position of a piston of a fluid pressure cylinder using a magnetostriction type position detecting device. The position detecting device detects a position of a permanent magnet by using a magnetostrictive line composed of a ferromagnetic material and the permanent magnet, generating ultrasonic oscillation to the magnetostrictive line at a position corresponding to the permanent magnet by the mutual action between a magnetic field generated when a current pulse flows to the elastic layer and a magnetic field generated by the permanent magnet, and detecting the ultrasonic oscillation traveling in the magnetostrictive line by a receive coil (detection coil). Then, an operating position in the entire stroke of the piston is detected by attaching the permanent magnet to the piston and the magnetostrictive line to a cylinder tube.

Incidentally, in the technology disclosed in the patent document 1, the position detecting device has a metal probe in which the magnetostrictive line is accommodated, and the probe is fitted into a groove of the cylinder tube composed of aluminum alloy and the like in an electrically insulated state. That is, the probe is formed by inserting the magnetostrictive line into a cylindrical pipe composed of a conductive material such as metal and the like, electrically connecting the extreme end of the magnetostrictive line to the extreme end of the cylindrical pipe, and disposing the detection coil to the base end of the cylindrical pipe. The outer periphery of the probe is covered with an insulation tube, and the probe is fitted into the groove of the cylinder tube in the electrically insulated state through the insulation tube. Then, the cylindrical pipe functions as a feedback conductor of the current pulse supplied to the magnetostrictive line. Patent Document 1: Japanese Unexamined Patent Application Publication No. 9-329409

DISCLOSURE OF THE INVENTION

However, when the probe is formed by accommodating the magnetostrictive line in the cylindrical metal pipe and the cylindrical pipe is provided with the function as the current feedback conductor as described above, electric insulation must be carried out between the cylindrical pipe and the magnetostrictive line and between the cylindrical pipe and the cylinder tube, respectively. Thus, not only a structure for insulation becomes complex but also the outside diameter of the probe is increased by the insulation tube, and the like with a result that the cylinder tube cannot be attached compactly.

Accordingly, an object of the present invention is to provide a fluid pressure cylinder with a position detecting device having such a simple and rational design structure that it is not necessary to use a metal probe as a feedback conductor of a current pulse supplied to a magnetostrictive line and to dispose other special conductive member and the like.

To achieve the above object, according to the present invention, there is provided a fluid pressure cylinder with a position detecting device comprising a cylinder tube, a piston linearly moving in the cylinder tube by the action of a fluid pressure, and the magnetostriction type position detecting device for detecting an operating position of the piston, wherein the position detecting device comprises a magnetostrictive line extending along the cylinder tube and a permanent magnet moving in the cylinder tube in synchronism with the piston, and when a current pulse is supplied to the magnetostrictive line, the operating position of the piston is detected from ultrasonic oscillation generated to the magnetostrictive line at a position corresponding to the permanent magnet. In the fluid pressure cylinder, the cylinder tube is formed of a non-magnetic conductive material, a hole- or groove-shaped hollow portion extending in parallel with a moving direction of the permanent magnet is formed to the cylinder tube, the magnetostrictive line comprising a ferromagnetic material is inserted into the hollow portion, and the extreme end of the magnetostrictive line is electrically connected to the cylinder tube, thereby the cylinder tube is also used as a current feedback conductor.

In the present invention, the magnetostrictive line may be directly accommodated in the hollow portion or may be disposed in the hollow portion through a holding cylinder composed of a non-conductive material by being accommodated in the holding cylinder.

Further, in the present invention, a pulse input unit for inputting a current pulse may be disposed to the base end side of the magnetostrictive line as well as a detection coil may be disposed to detect the ultrasonic oscillation traveling in the magnetostrictive line.

When the magnetostrictive line is accommodated in the holding cylinder, the detection coil is disposed to an end of the holding cylinder.

In the present invention, an oscillation absorber is preferably disposed to at least one of the extreme end and the base end of the magnetostrictive line to absorb the ultrasonic oscillation traveling in the magnetostrictive line.

According to the fluid pressure cylinder with the position detecting device of the present invention, since the conductive cylinder tube itself is also used as the current feedback conductor, it can be provided with a very simple and rational design structure because it is not necessary to use a metal probe and to specifically provide other conductive member as in a conventional fluid pressure cylinder.

BEST MODE FOR CARRYING OUT THE INVENTION

Figure 1:
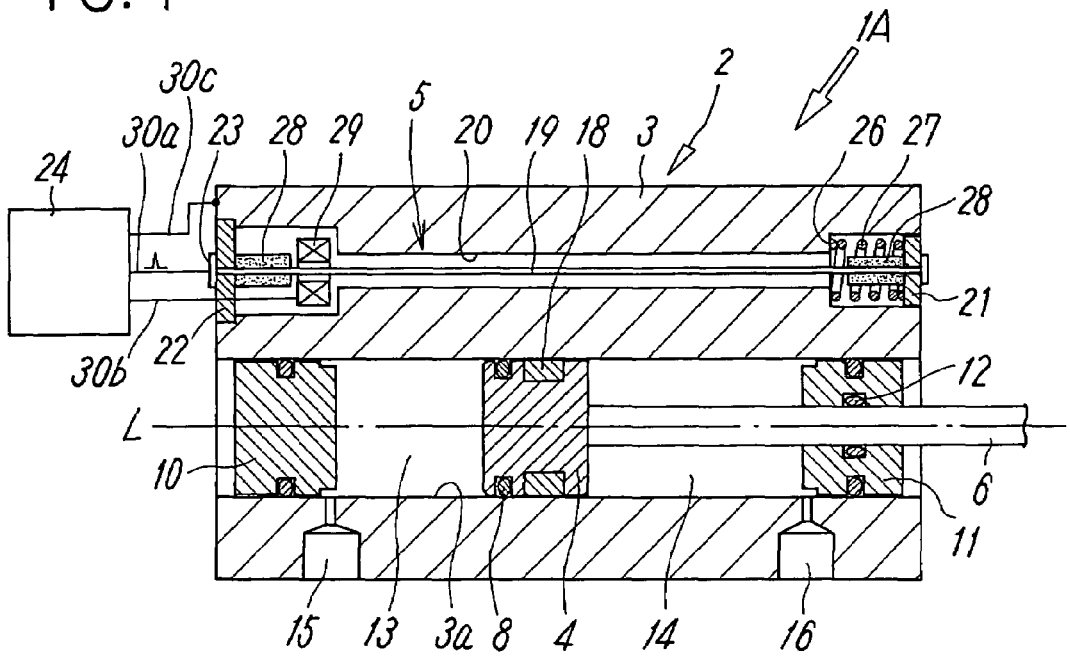
FIG. 1 is a sectional view showing a first embodiment of a fluid pressure cylinder with a position detecting device according to the present invention.
Figure 2:
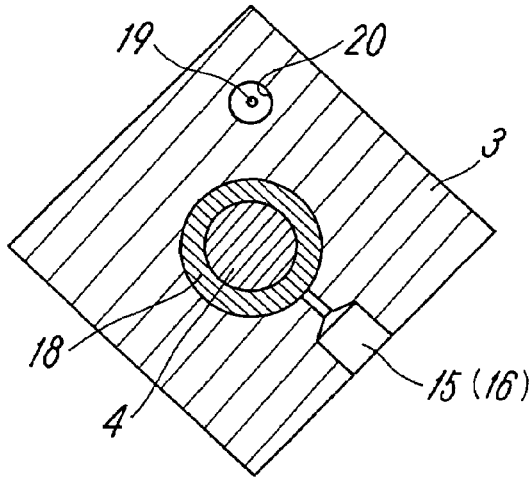
FIG. 2 is a sectional view taken along the line II-II in FIG. 1.

FIGS. 1 and 2 schematically show a first embodiment of a fluid pressure cylinder with a position detecting device according to the present invention. The fluid pressure cylinder 1A is formed by assembling a magnetostriction type position detecting device 5 for detecting an operating position of a piston 4 to a cylinder main body 2 composed of a cylinder tube 3 and the piston 4.

The cylinder main body 2 has the same basic structure as a known basic structure and has the cylinder tube 3 composed of a non-magnetic conductive material such as aluminum alloy. The piston 4 is disposed in a circular cylinder bore 3*a* formed to the cylinder tube 3 so as to linearly slide in the direction along a center axis L of the cylinder bore 3*a* through a seal member 8, and an end of a rod 6 is coupled with the piston 4. Both the ends of the cylinder bore 3*a* are closed by a head cover 10 and a rod cover 11 airtight, the rod 6 slidably passes through the rod cover 11 of the covers 10, 11 through a seal member 12, and the extreme end of the rod 6 extends to the outside of the cylinder bore 3*a*.

A head side pressure chamber 13 and a rod side pressure chamber 14 are formed between the piston 4 and the respective covers 10, 11 and communicate with a head side port 15 and rod side port 16 formed to the cylinder tube 3, respectively. When a pressure fluid such as compressed air is supplied from the head side port 15 to the head side pressure chamber 13, the piston 4 moves to the rod cover 11 side, whereas when the pressure fluid is supplied from the rod side port 16 to the rod side pressure chamber 14, the piston 4 moves to the head cover 10 side.

The position detecting device 5 includes a permanent magnet 18 that moves in synchronism with the piston 4 and a magnetostrictive line 19 attached to the cylinder tube 3.

The permanent magnet 18 is formed in a ring shape, attached around the outer periphery of the piston 4 so as to surround it, and magnetized with an N-pole and an S-pole in the center axis L direction or in a radial direction. However, the permanent magnet 18 may be formed in a shape other than the ring shape, for example, in a rod shape and may be attached to the piston 4 by being buried in the piston 4 at an appropriate position.

Further, the magnetostrictive line 19 is a straight wire member, which is composed of a ferromagnetic material and has a circular cross section and a uniform size, and is accommodated in a hollow portion 20 formed to the cylinder tube 3. The magnetostrictive line 19 preferably has an elastic modulus that is less changed by a change of temperature so that it is unlike to be affected by temperature, and elinvar alloy, nickel alloy, and the like, for example, are preferably used.

The hollow portion 20 is composed of a circular hole formed at a position adjacent to the cylinder bore 3*a* in parallel with it, and the magnetostrictive line 19 is inserted into the hollow portion 20 in non-contact with the inner wall of the hollow portion 20 in parallel with the center axis L. The extreme end of the magnetostrictive line 19 is connected to a support metal fitting 21 accommodated the hollow portion 20 at an end of it and electrically connected to the cylinder tube 3 through the support metal fitting 21. That is, the support metal fitting 21 is composed of a conductive material such as copper, aluminum, and the like and formed in a disc shape. The support metal fitting 21 is disposed in the hollow portion 20 so as to move in the center axis direction of the hollow portion, is electrically conductive with the cylinder tube 3 by that the outer peripheral surface of it is in contact with the inner peripheral surface of the hollow portion 20, thereby the cylinder tube 3 is also used a current feedback conductor.

In contrast, the base end of the magnetostrictive line 19 that is the end of it opposite to the above extreme end is fixedly supported by the base end of the hollow portion 20 through a non-conductive support member 22 composed of synthetic resin and the like, and a pulse input unit 23 is disposed to the outside of the support member 22 to input a current pulse from an amplifier 24 to the magnetostrictive line 19.

The magnetostrictive line 19 is disposed with a predetermined tension applied to it. To apply the tension, a coil spring 27 is interposed between the support metal fitting 21 and a spring receiver 26 formed to the hollow portion 20, and the support metal fitting 21 is pressed in a direction in which the magnetostrictive line 19 extends at all times by the spring force of the coil spring 27.

Note that the support metal fitting 21 may be formed of a non-conductive material and the extreme end of the magnetostrictive line 19 may be connected to the cylinder tube 3 through another conductor such as a lead wire in place of electrically connecting the magnetostrictive line 19 to the cylinder tube 3 through the support metal fitting 21.

Oscillation absorbers 28 are disposed to the extreme end and the base end of the magnetostrictive line 19 to absorb ultrasonic oscillation traveling in the magnetostrictive line 19 so that they prevent reflection of the ultrasonic oscillation. The oscillation absorbers 28 are formed of an elastic material such as rubber and synthetic resin and attached to the magnetostrictive line 19 so as to cover the entire outer periphery of it. However, the oscillation absorber 28 may be disposed to any one of the extreme end and the base end of the magnetostrictive line 19.

Further, a detection coil 29 is disposed to the base end side of the hollow portion 20 at a position inward of (nearer to the center than) the oscillation absorber 28 so as to surround the base end of the magnetostrictive line 19 so that the detection coil 29 detects the ultrasonic oscillation traveling in the magnetostrictive line 19 as a pulse voltage.

The pulse input unit 23, the detection coil 29, and the cylinder tube 3 are electrically connected to the amplifier 24 through conducting wires 30*a*, 30*b*, 30*c*, respectively. The amplifier 24 has a function for supplying the current pulse to the magnetostrictive line 19 and a function for amplifying the current pulse from the detection coil 29. A magnetostriction sensor for detecting a position of the permanent magnet 18 is composed of the amplifier 24, the magnetostrictive line 19, and the detection coil 29. Accordingly, the magnetostrictive line 19 and the detection coil 29 constitute a detection unit of the magnetostriction sensor.

Figure 3:
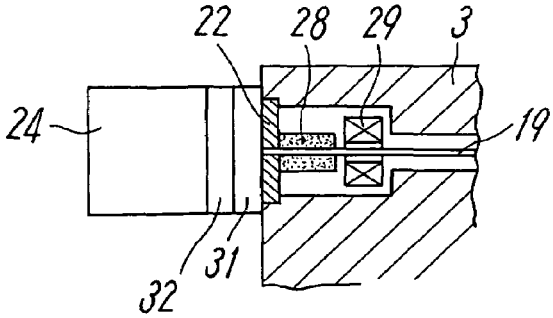
FIG. 3 is a sectional view of a main portion showing a preferable modification of the first embodiment.

Note that, as shown in FIG. 3, it is also possible to form a connector 31, which has a male or female terminal, at an end of the cylinder tube 3 to electrically connect the pulse input unit 23, the detection coil 29, and the cylinder tube 3, respectively, to form a connector 32, which has a female or male terminal that can be electrically connected to the male or female terminal by a plug-in system, to the amplifier 24, and to removably attach the amplifier 24 to the cylinder main body 2 by connecting the connectors 31, 32 to each other.

When the current pulse is supplied from the amplifier 24 to the pulse input unit 23 of the magnetostrictive line 19 through the conducting wire 30*a*, the current pulse flows in the magnetostrictive line 19 from the base end to the extreme end of it. At the time, a magnetic field is generated in the circumferential direction of the magnetostrictive line 19 by the current pulse.

In contrast, a magnetic field is generated at an operating position of the piston 4 in the axial line L direction by the permanent magnet 18. A twist distortion is generated to the magnetostrictive line 19 at a position corresponding to the permanent magnet 18 by the mutual action of the magnetic field in the axial line direction generated by the permanent magnet 18 and the circumferential magnetic field generated by the current pulse. The twist distortion is a kind of ultrasonic oscillation and travels in the magnetostriction line 19 from the base end to the extreme end of it, thereby the ultrasonic oscillation traveling to the base end generates a pulse voltage in the detection coil 29. Thus, when the pulse voltage is detected and amplified by the amplifier 24 and subjected to necessary arithmetic operation processing by an arithmetic operation unit, the traveling time of the ultrasonic oscillation from the position of the permanent magnet 18 to the base end of the magnetostrictive line 19 is calculated, and the position of the permanent magnet 18, that is, the position of the piston 4 can be detected from the traveling time.

The ultrasonic oscillation that has reached both the ends of the magnetostrictive line 19 is absorbed by the oscillation absorbers 28, thereby malfunction due to the reflection of it can be prevented.

Accordingly, in the fluid pressure cylinder 1A, since the cylinder tube 3 is formed the non-magnetic conductive material and also used as the current feedback conductor, it is not necessary to use a metal probe and to specially provide other conductive member as in a conventional fluid pressure cylinder. As a result, the fluid pressure cylinder 1A can be provided with a very simple and rational design structure. Moreover, since electric insulations between a metal pipe and the magnetostrictive line 19 and between the metal pipe and the cylinder tube 3, which are necessary when a metal probe is used, are not necessary, the fluid pressure cylinder 1A can be more simplified in structure and reduced in size.

Figure 4:
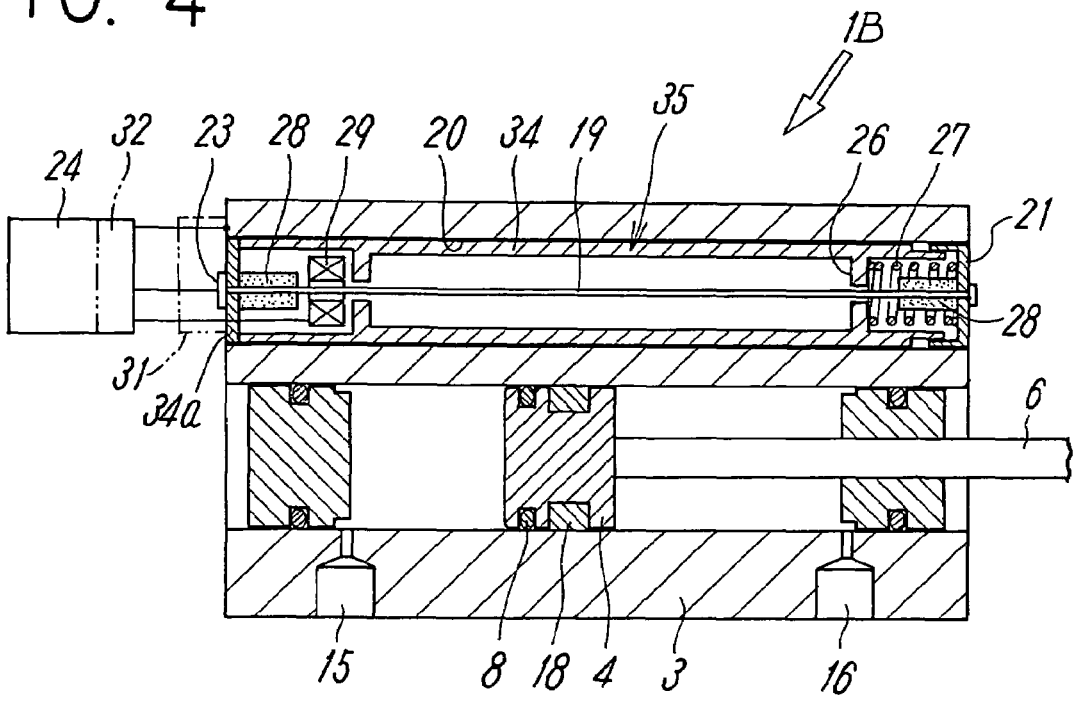
FIG. 4 is a sectional view showing a second embodiment of the present invention.

FIG. 4 schematically shows a second embodiment of the present invention. A fluid pressure cylinder 1B of the second embodiment is different from the fluid pressure cylinder 1A of the first embodiment in that a detection unit of a magnetostriction sensor is formed in the shape of a probe 35 by accommodating a magnetostrictive line 19 in a holding cylinder 34 composed of a non-conductive material and that the magnetostrictive line 19 is disposed in a hollow portion 20 through the holding cylinder 34 by inserting the probe 35 into the hollow portion 20. The probe 35 is removably attached to the hollow portion 20.

Figure 5:
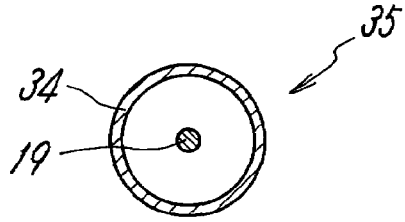
FIG. 5 is a sectional view of a probe.

The holding cylinder 34 is formed of synthetic resin in a linear cylindrical shape. As shown in FIG. 5, the magnetostrictive line 19 is inserted to the center of the holding cylinder 34, and the base end of the magnetostrictive line 19 is fixedly supported by an end wall 34a of the holding cylinder 34 on the base end side of it. Further, a cap-like support metal fitting 21, which is composed of a conductive material such as copper, aluminum, and the like, is attached to the extreme end of the holding cylinder 34 so as to move in the axial direction of the holding cylinder 34. The support metal fitting 21 is electrically conductive with the cylinder tube 3 by causing the outer peripheral surface of it to come into contact with the inner peripheral surface of the hollow portion 20, and the magnetostrictive line 19 is electrically connected to the cylinder tube 3 through the support metal fitting 21 by connecting the extreme end of the magnetostrictive line 19 to the support metal fitting 21.

A coil spring 27 is interposed between the support metal fitting 21 and a spring receiver 26 in the holding cylinder 34, and a predetermined tensile force is applied to the magnetostrictive line 19 by the coil spring 27.

Further, a detection coil 29 is incorporated in the pulse input unit 23 on the base end side of it so as to surround the magnetostrictive line 19.

Since the arrangements of the second embodiment other than the above arrangement and a preferable modification and the like of the second embodiment are substantially the same as the first embodiment, the same main components of them are denoted by the same reference numerals of the first embodiment and the explanation of them is omitted.

In the fluid pressure cylinder 1B of the second embodiment, since the holding cylinder 34 is formed of the non-magnetic material, when the magnetostrictive line 19 is attached to the inside of it and when it is inserted into the hollow portion 20, it is not necessary to subject the inner and outer peripheries of the holding cylinder 34 to an electric insulation treatment. Accordingly, the fluid pressure cylinder 1B is simple in structure, the magnetostrictive line 19 can be easily attached, and the holding cylinder 34 can be easily attached to the cylinder tube 3.

Note that it is possible to form connectors 31 and 32, which can be electrically connected by a plug-in system, to the base end of the holding cylinder 34 and to an amplifier 24 so that the amplifier 24 can be removably attached by connecting the connectors to each other also in the second embodiment likewise the first embodiment.

Figure 6:
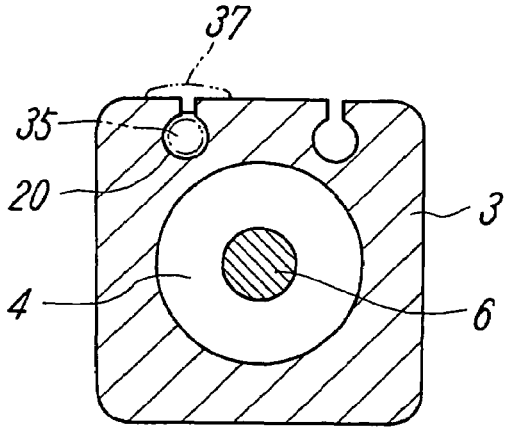
FIG. 6 is a sectional view showing a different example of a hollow portion disposed to a cylinder main body.

In the respective embodiments, although the hole-shaped hollow portion 20 is formed to the cylinder tube 3 and the magnetostrictive line 19 is accommodated in the hollow portion 20. However, the hollow portion 20 may be formed in a groove shape as shown in FIG. 6. The groove has a groove bottom whose width is larger than that of a groove inlet, and a lid 37 is attached to the groove as necessary to close the groove inlet. When the hollow portion 20 is formed in the groove shape, a detector of a sensor formed as the probe 35 by accommodating the magnetostrictive line 19 in the holding cylinder 34 is preferably used as in the second embodiment.

The invention claimed is:

1. A fluid pressure cylinder with a position detecting device comprising a cylinder tube, a piston linearly moving in the cylinder tube by the action of a fluid pressure, and the magnetostriction type position detecting device for detecting an operating position of the piston, wherein the position detecting device comprises a magnetostrictive line extending along the cylinder tube and a permanent magnet moving in the cylinder tube in synchronism with the piston, and when a current pulse is supplied to the magnetostrictive line, the operating position of the piston is detected from ultrasonic oscillation generated to the magnetostrictive line at a position corresponding to the permanent magnet, the fluid pressure cylinder characterized in that:

the cylinder tube is formed of a non-magnetic conductive material, a hole-or groove-shaped hollow portion extending in parallel with a moving direction of the permanent magnet is formed to the cylinder tube, the magnetostrictive line comprising a ferromagnetic material is inserted into the hollow portion, and the extreme end of the magnetostrictive line is electrically connected to the cylinder tube, thereby the cylinder tube is also used as a current feedback conductor, wherein the hollow portion is a groove, the groove comprises a groove inlet to open on an outer surface of the cylinder tube, and the groove inlet is covered by a lid.

2. A fluid pressure cylinder according to claim 1, wherein the magnetostrictive line is directly accommodated in the hollow portion.

3. A fluid pressure cylinder according to claim 2, wherein a pulse input unit for inputting a current pulse is disposed to the base end side of the magnetostrictive line as well as a detection coil is disposed to detect the ultrasonic oscillation traveling in the magnetostrictive line.

4. A fluid pressure cylinder according to claim 3, wherein an oscillation absorber is disposed to at least one of the extreme end and the base end of the magnetostrictive line to absorb the ultrasonic oscillation traveling in the magnetostrictive line.

5. A fluid pressure cylinder according to claim 2, wherein an oscillation absorber is disposed to at least one of the extreme end and the base end of the magnetostrictive line to absorb the ultrasonic oscillation traveling in the magnetostrictive line.

6. A fluid pressure cylinder according to claim 1, wherein the magnetostrictive line is accommodated in a holding cylinder comprising a non-conductive material and disposed in the hollow portion through the holding cylinder.

7. A fluid pressure cylinder according to claim 6, wherein a pulse input unit for inputting a current pulse is disposed to the base end side of the magnetostrictive line as well as a detection coil is disposed to detect the ultrasonic oscillation traveling in the magnetostrictive line.

8. A fluid pressure cylinder according to claim 7 wherein the detection coil is disposed to an end of the holding cylinder.

9. A fluid pressure cylinder according to claim 8, wherein an oscillation absorber is disposed to at least one of the extreme end and the base end of the magnetostrictive line to absorb the ultrasonic oscillation traveling in the magnetostrictive line.

10. A fluid pressure cylinder according to claim 7, wherein an oscillation absorber is disposed to at least one of the extreme end and the base end of the magnetostrictive line to absorb the ultrasonic oscillation traveling in the magnetostrictive line.

11. A fluid pressure cylinder according to claim 6, wherein an oscillation absorber is disposed to at least one of the extreme end and the base end of the magnetostrictive line to absorb the ultrasonic oscillation traveling in the magnetostrictive line.

12. A fluid pressure cylinder according to claim 1, wherein a pulse input unit for inputting a current pulse is disposed to the base end side of the magnetostrictive line as well as a detection coil is disposed to detect the ultrasonic oscillation traveling in the magnetostrictive line.

13. A fluid pressure cylinder according to claim 12, wherein an oscillation absorber is disposed to at least one of the extreme end and the base end of the magnetostrictive line to absorb the ultrasonic oscillation traveling in the magnetostrictive line.

14. A fluid pressure cylinder according to claim 1, wherein an oscillation absorber is disposed to at least one of the extreme end and the base end of the magnetostrictive line to absorb the ultrasonic oscillation traveling in the magnetostrictive line.

15. A fluid pressure cylinder according to claim 1, wherein the magnetostrictive line is surrounded by a non-conductive material.

16. A fluid pressure cylinder according to claim 15, wherein a holding cylinder is made from the non-conductive material, and the magnetostrictive line is accommodated in the holding cylinder and disposed in the hollow portion through the holding cylinder.

* * * * *